US007976000B2

(12) United States Patent
Kawaguchi

(10) Patent No.: US 7,976,000 B2
(45) Date of Patent: Jul. 12, 2011

(54) SHEET STACKING APPARATUS, SHEET PROCESSING APPARATUS AND SHEET STACKING METHOD

(75) Inventor: Takahiro Kawaguchi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 280 days.

(21) Appl. No.: 12/335,296

(22) Filed: Dec. 15, 2008

(65) Prior Publication Data

US 2009/0152788 A1 Jun. 18, 2009

(30) Foreign Application Priority Data

Dec. 17, 2007 (JP) ..... P2007-324202

(51) Int. Cl.
*B65H 37/04* (2006.01)

(52) U.S. Cl. ..... 270/37; 270/32; 270/45; 270/46; 270/58.07; 270/58.08; 270/58.11; 270/58.12; 270/58.17; 270/58.27

(58) Field of Classification Search ..... 270/4, 12, 270/20.1, 32, 37, 45, 46, 51, 58.07, 58.08, 270/58.09, 58.11, 58.12, 58.17, 58.27
See application file for complete search history.

(56) References Cited

U.S. PATENT DOCUMENTS

| | | | | |
|---|---|---|---|---|
| 6,735,415 | B2 * | 5/2004 | Isobe et al. | 399/410 |
| 7,159,860 | B2 * | 1/2007 | Sasahara | 270/58.14 |
| 2004/0070133 | A1 * | 4/2004 | Yamada et al. | 270/32 |
| 2006/0066021 | A1 * | 3/2006 | Sasahara | 270/58.11 |

FOREIGN PATENT DOCUMENTS

JP 09-183558 7/1997

* cited by examiner

*Primary Examiner* — Leslie A Nicholson, III
(74) *Attorney, Agent, or Firm* — Patterson & Sheridan, LLP

(57) ABSTRACT

A sheet stacking apparatus includes a first and a second guide plate having a guide surface inclined to a perpendicular plane to take an open state having a gap of a first interval in a direction crossing the inclination direction and a closed state of a second interval narrower than the first interval, a sheet take-in portion standing by under the first and second guide plates to support sheets dropped from the guide surfaces with the leading edge thereof in a conveying direction directed downward in a standing position, and a controller configured to permit the first and second guide plates to enter the closed state and guide another sheets conveyed following the sheets supported internally by the sheet take-in portion by the guide surfaces and then to enter the open state and drop the another sheets from the gaps onto the preceding sheets.

17 Claims, 13 Drawing Sheets

SHEET STACKING APPARATUS, SHEET PROCESSING APPARATUS AND SHEET STACKING METHOD

CROSS-REFERENCE TO RELATED APPLICATION

This application is based upon and claims the benefit of priority from the prior Japanese Patent Application No. 2007-324202, filed on Dec. 17, 2007, the entire contents of all of which are incorporated herein by reference.

TECHNICAL FIELD

The present invention relates to a sheet stacking apparatus for stacking sheets conveyed and a sheet processing apparatus and a sheet stacking method for folding the sheets stacked on the sheet stacking apparatus.

BACKGROUND

A sheet processing apparatus for performing the processes of stapling, punching, and folding is disclosed in Patent Document 1.

The apparatus disclosed in Japanese Patent Application Publication No. 9-183558 switches a storage unit for temporarily storing image-formed sheets sequentially discharged from an image forming apparatus and a conveying path of sheets conveyed to the storage unit for each sheet size. The apparatus has a plurality of switching flaps. The switching flaps are driven by a solenoid. By use of such a constitution, the succeeding sheet, without getting into a sheet bundle already stacked on a processing tray, can be stacked at the uppermost position.

However, in the aforementioned apparatus, if the kinds of sheet sizes are increased, the number of flaps and solenoids for switching the sheet conveying path must be increased. Therefore, the cost and mounting man-hour are increased in correspondence with an increase in the number of components. Or, since there are many components equipped, a wide space is required, thus the apparatus increases in size.

Further, a plurality of sheet conveying paths are formed, so that to detect an abnormal system due to jamming of sheets conveyed on each sheet conveying path, for each conveying path, for example, for each flapper, a mechanical sensor is necessary to install for detecting passing of sheets, thus a problem arises that the cost and mounting man-hour are increased similarly.

SUMMARY

Described herein is a sheet stacking apparatus for appropriately stacking sheets and a sheet processing apparatus for folding the sheets stacked on the sheet stacking apparatus.

Described herein is a sheet stacking apparatus, comprising a first and a second guide plate which have a guide surface inclined to a perpendicular plane to take a gap in a direction crossing an inclination direction, the gap at an open state being a first interval, the gap at a closed state being a second interval narrower than the first interval; a sheet take-in portion which stands by under the first and second guide plates to support sheets dropped from the guide surfaces with a leading edge thereof in a conveying direction directed downward in a standing position; and a controller configured to permit the first and second guide plates to enter the closed state and guide another sheets conveyed following the sheets supported internally by the sheet take-in portion by the guide surfaces and then to enter the open state and drop the another sheets from the gaps onto the preceding sheets.

Described herein is a sheet processing apparatus, comprising a first and a second guide plate which have a guide surface inclined to a perpendicular plane to take a gap in a direction crossing an inclination direction, the gap at an open state being a first interval, the gap at a closed state being a second interval narrower than the first interval; a sheet take-in portion which stands by under the first and second guide plates to support sheets dropped from the guide surfaces with a leading edge thereof in a conveying direction directed downward in a standing position; a controller configured to permit the first and second guide plates to enter the closed state and guide another sheets conveyed following the sheets supported internally by the sheet take-in portion by the guide surfaces and then to enter the open state and drop the another sheets from the gaps onto the preceding sheets; a saddle unit configured to staple a plurality of sheets stacked in the sheet take-in portion; and a sheet folding unit configured to fold the plurality of sheets stapled by the saddle unit.

Furthermore, described herein is a sheet stacking method, comprising standing by under a first and a second guide plate which have a guide surface inclined to a perpendicular plane to take a gap in a direction crossing an inclination direction, the gap at an open state being a first interval, the gap at a closed state being a second interval narrower than the first interval and supporting sheets dropped from the guide surfaces with a leading edge thereof in a conveying direction directed downward in a standing position; and permitting the first and second guide plates to enter the closed state, guide another sheets conveyed following the sheets supported in the standing position by the guide surfaces, then enter the open state, drop the another sheets from the gaps onto the preceding sheets, thereby store the preceding sheets and the another sheets.

DETAILED DESCRIPTION

First Embodiment

Figure 1:
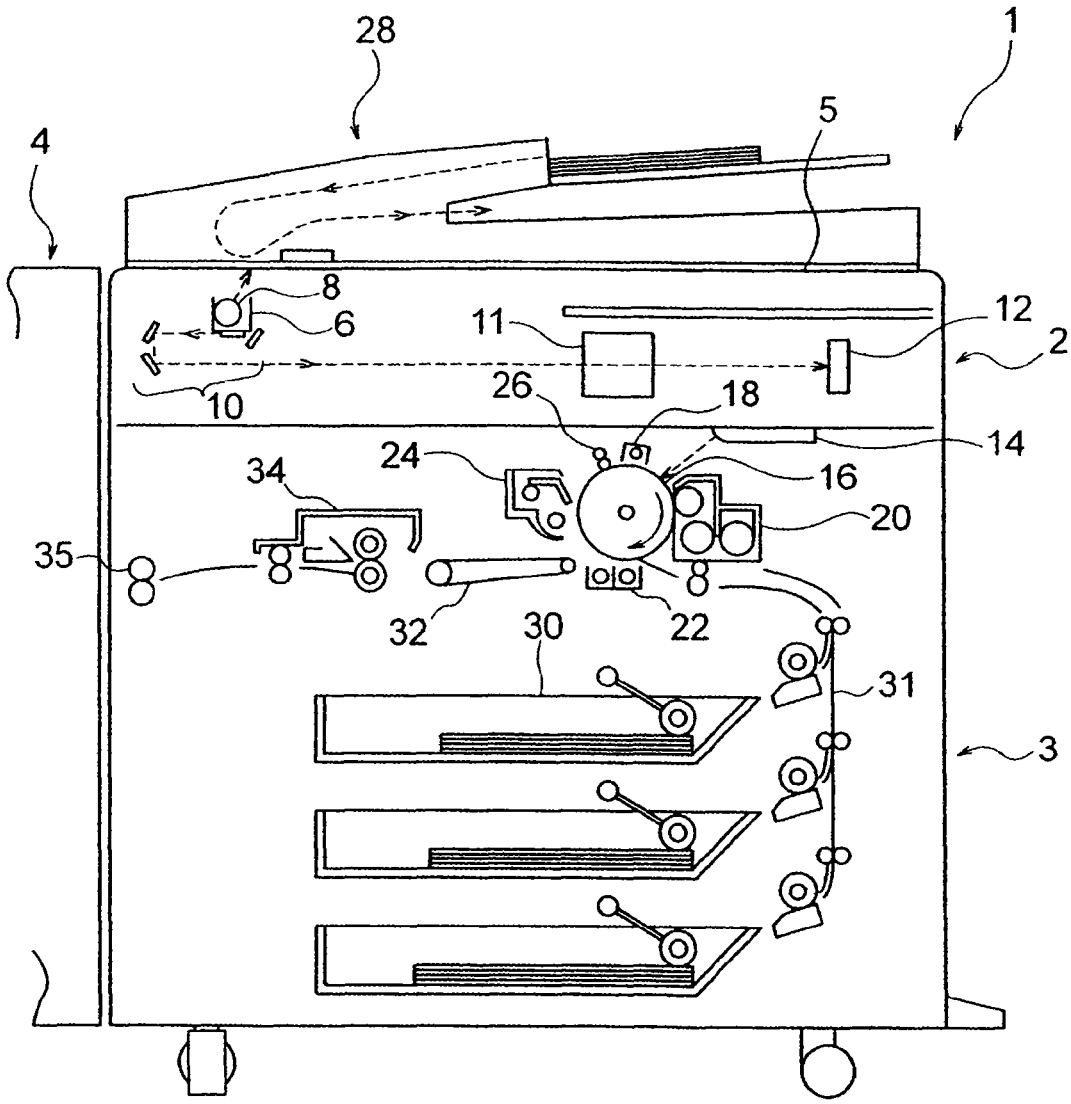
FIG. 1 is a schematic block diagram of the image forming apparatus of the first embodiment.

FIG. 1 is a schematic block diagram of the image forming apparatus.

An image forming apparatus 1 includes a scanner 2 for reading an image to be read and a printer 3 for forming an image.

The scanner 2 includes a transmissible platen 5, a carriage 6, a lamp 8, a mirror 10, an imaging lens for converging reflected light, and a CCD (charge coupled device) 12 for fetching the reflected light and converting image information by light to an analog signal.

The printer 3 includes a photoconductor 16, a laser unit 14 for forming an electrostatic latent image on the photoconductor 16, and a charger 18, a developing device 20, a transferring device 22, a cleaner 24, and a discharging lamp which are sequentially arranged around the photoconductor 16.

To a document put on the platen 5 or a document sent by an automatic document feeder 28, by the exposure unit having the carriage 6 and the lamp 8 installed on the carriage 6, light is irradiated from the underneath of the platen 5. The reflected light from the document is induced by the mirror 10 and is converged by the imaging lens 11, thus an reflected light image is projected on the CCD 12. The image information fetched by the CCD 12 is outputted by the analog signal and then is converted to a digital signal. The digital signal is image-processed and then is transmitted to the laser unit 14.

If image formation is started in the printer 3, the charger 18 supplies an electrical charge to the outer peripheral surface of the rotating photoconductor 16. To the outer peripheral surface of the photoconductor 16 charged at a uniform electrical potential in the axial direction by the charger 18, according to the image information transmitted from the CCD 12, a laser beam is irradiated from the laser unit 14. By the irradiation of the laser beam, on the outer peripheral surface of the photoconductor 16, an electrostatic latent image corresponding to the image information of the document is formed. A developer (for example, toner) is fed to the outer peripheral surface of the photoconductor 16 by the developing device 20 and the electrostatic latent image is converted to a toner image.

The developing device 20 has a developing roller installed rotatably. The developing roller is arranged opposite to the photoconductor 16 and rotates, so that toner is fed to the photoconductor 16. If a toner image is formed on the outer peripheral surface of the photoconductor 16, onto a sheet conveyed from a sheet feeder 30 via a conveying path 31, the toner image is transferred electrostatically by the transferring device 22. The sheet is conveyed to a fixing device 34 via a conveying belt 32 and the toner image transferred onto the sheet is fixed on the sheet by the fixing device 34. The sheet that the toner image is fixed, thus the image formation is completed is discharged from the image forming apparatus 1 by discharge rollers 35 and is sent to the finisher 4. The sheet is referred to as, for example, ordinary paper, heavy paper, thin paper, glossy paper, and an OHP sheet.

On the other hand, the toner remaining on the photoconductor without transferred is removed by the cleaner 24 positioned on the downstream side of the transferring device 22 in the rotational direction of the photoconductor 16. The residual electric charge on the outer peripheral surface of the photoconductor 16 is removed by the discharging lamp 26.

Figure 2:
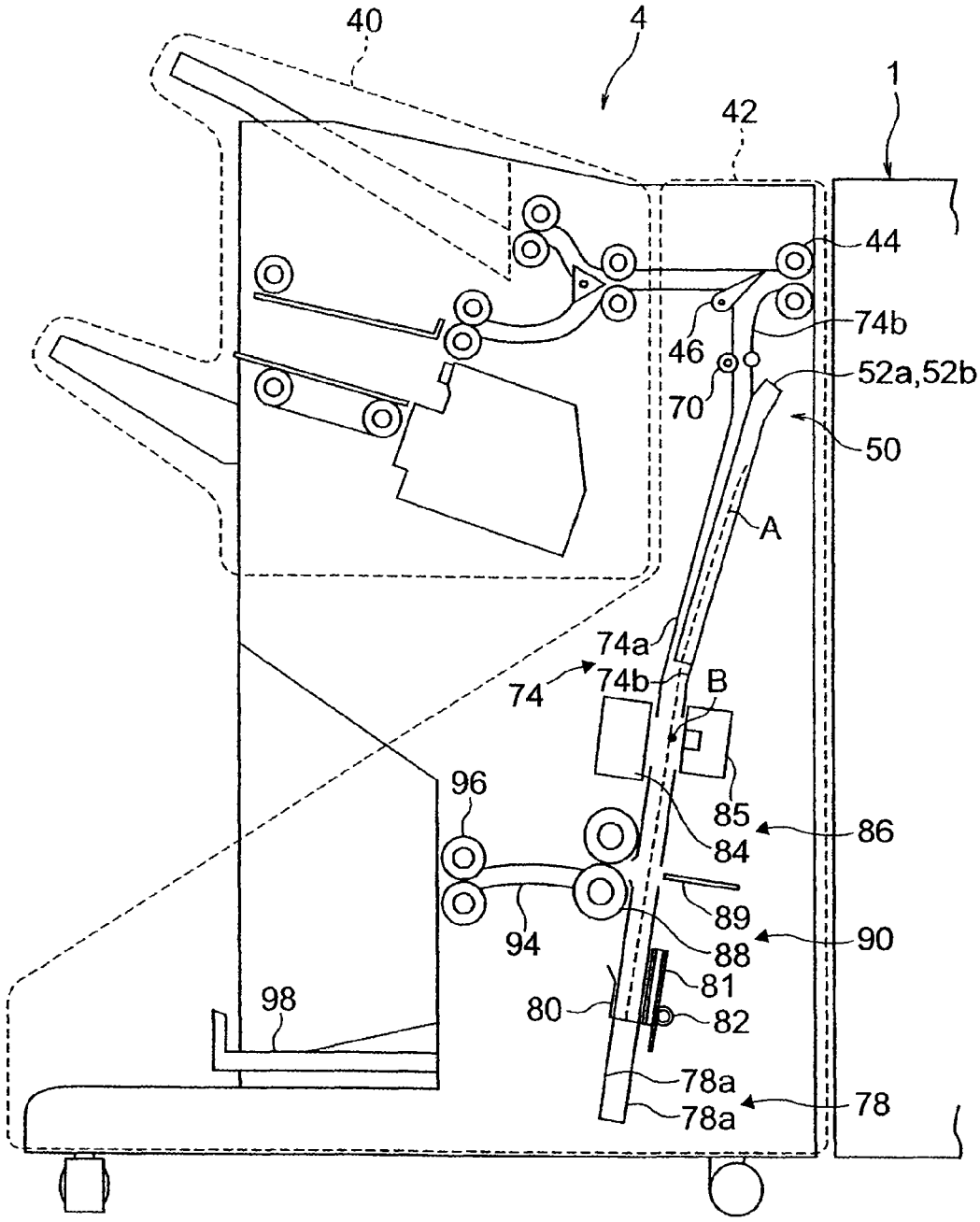
FIG. 2 is a schematic block diagram of the finisher of the first embodiment.

FIG. 2 is a schematic diagram of the finisher.

The finisher 4 post-processes sheets discharged from the image forming apparatus 1 according to an input instruction from the operation panel of the image forming apparatus 1 or a processing instruction from a personal computer (PC). The finisher 4 includes a first finishing portion 40 for performing the post processes other than the folding process and stapling process, for example, the general sorting process and the stapling process of the end of a sheet bundle and a second finishing portion (sheet folding device) 42 for performing the folding process and stapling process. Further, the first finishing portion 40 can use the post processing apparatus described in Japanese Patent Application Publication No. 2007-76862 and well-known techniques.

The second finishing portion 42 includes a branching member 46 for switching the conveying path according to the post-process of sheets and a sheet take-in portion (sheet stacking apparatus) 50 for sequentially stacking conveyed sheets so as to prevent succeeding sheets from getting into a sheet bundle stacked already. The second finishing portion 42 further includes a saddle unit 86 having a stapler 84 and an anvil 85 and a sheet folding unit 90 having a folding roller pair 88 and a folding plate 89. A sheet bundle folded by the sheet folding unit 90 is discharged onto a receiving tray 98 via a path 94 and a carrying-out roller 96.

In the finisher 4, an entrance roller 44 carries sheets discharged from the image forming apparatus 1 into the finisher 4.

When performing the folding process and stapling process, sheets are carried into the finisher 4 by the entrance roller 44. If the sheets are carried into the finisher 4, the branching member 46 deflects the path and a conveying roller 70 conveys the sheets to the sheet take-in portion 50 along a path 74 formed by the bottom of a guide member 74*a* and the top of a guide member 74*b*. In the sheet take-in portion 50, the sheets conveyed, via a first guide member 52*a* and a second guide member 52*b* which will be described later, are sent to a path 78 composed by guide members 78*a* and 78*b* which stand by under the first and second guide members 52*a* and 52*b* and a stacker 80 receives the leading edge of the sheets in the conveying direction.

The stacker 80 has a rack 81 and a pinion gear 82 meshing with the rack 81. Power is transmitted to the pinion gear 82 from the motor, so that the stacker 80 moves vertically along the linear longitudinal path. The stacker 80 executes positioning when needle-stapling by the stapler 84 and positioning when folding a sheet bundle by the sheet folding unit 90. The stacker 80, together with the guide members 74*a* and 74*b*, composes the sheet take-in portion for supporting conveyed sheets with the top thereof in the conveying direction directed downward in a standing position. Further, the leading edge of the sheets received by the stacker 80 is positioned in the first and second guide members 52*a* and 52*b* and the sheets are sequentially stacked without getting into the stacked sheet bundle. The stacker 80 is arranged so that the portion of the sheet bundle to be stapled comes to the position to be stapled by the stapler 84 and anvil 85. The portion of the sheet bundle to be stapled may be the central portion.

If sheets in correspondence to the number of job copies are stored by the stacker 80, the stapler 84 and anvil 85 staple a sheet bundle A. If the sheet bundle A is stapled, the stacker 80 moves down until the stapled portion of the sheet bundle A (hereinafter, the stapling position B) comes to the position of the folding plate 89 of the sheet folding unit 90. The folding plate 89 is shifted generally outside the path 78 from the guide member 78 so as to prevent obstruction to conveyance of sheets, moves when folding the sheet bundle A, presses the stapling position B of the sheet bundle A, and presses out the stapling position B toward the nip portion of the folding roller pair 88.

If the folding plate 89 of the sheet folding unit 90 presses the stapling position B of the sheet bundle A and presses the sheet bundle A into the nip portion of the folding roller pair 88, the folding roller pair 88 conveys the sheet bundle A under pressure in the nip portion and folds the sheet bundle A at the stapling position B.

By the sheet folding unit 90, the sheet bundle A folded is conveyed to the carrying-out roller 96 via the path 94 and then is discharged and stacked on the receiving tray 98.

Figure 3:
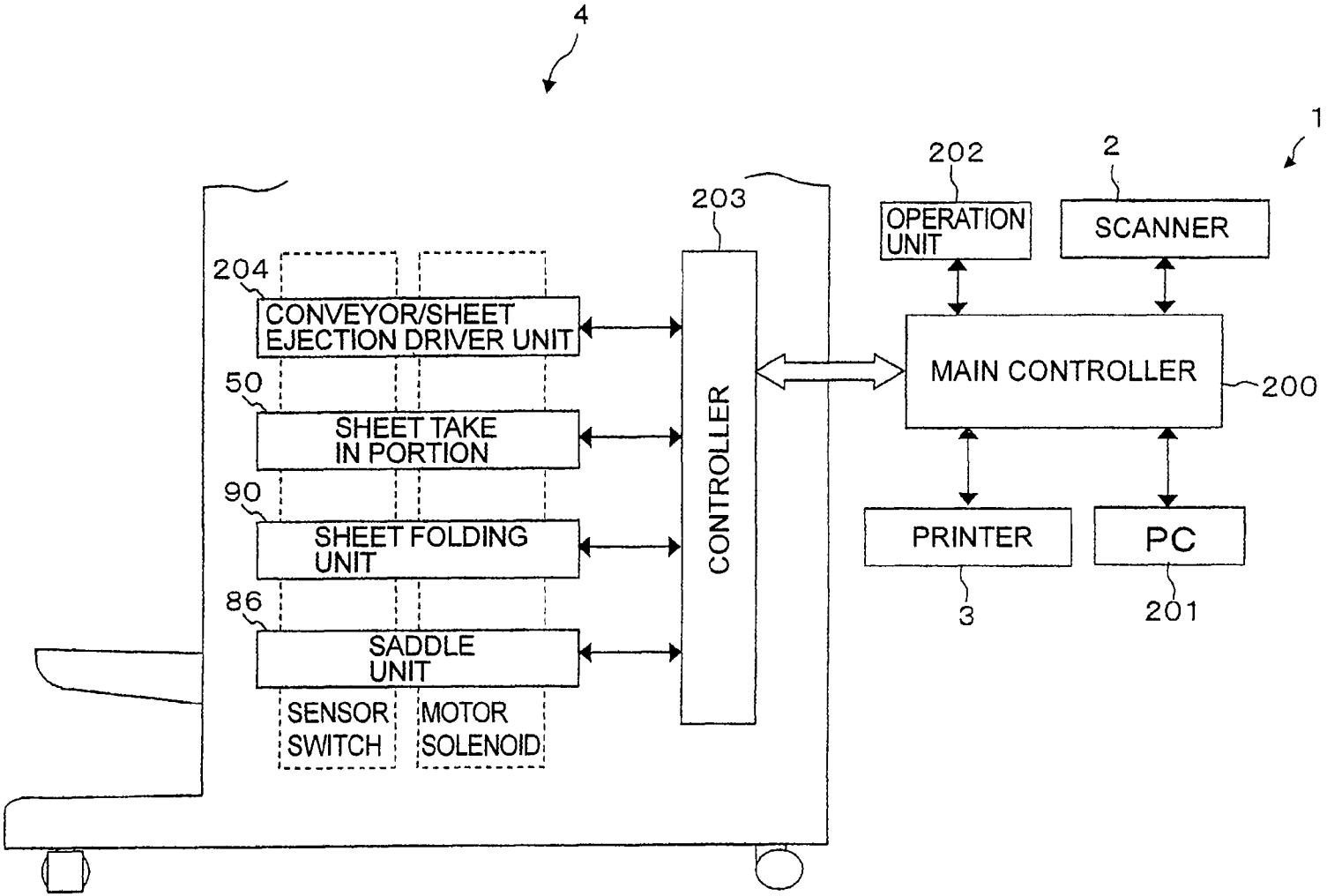
FIG. 3 is a schematic block diagram of the control system of the image forming apparatus and finisher.

FIG. 3 is a schematic block diagram of the control system of the image forming apparatus and finisher.

The image forming apparatus 1 has a main controller 200 for controlling the entire image forming apparatus 1. The main controller 200 synthetically controls the scanner 2, printer 3, an operation unit 202 such as the operation panel, and a controller 203 of the finisher 4. The main controller 200 performs not only the image processing such as correction, compression, and expansion of image data but also storage of compressed image data and print data and data communication with a PC (personal computer) 201 outside the image forming apparatus 1.

The operation unit 202 is composed of a liquid crystal display unit having a built-in touch panel and a hard key such as a ten-key pad.

Further, the finisher 4 has the controller 203 for controlling each operation of the second finishing portion 42. The controller 203 controls the operation of each of a conveyor/sheet ejection driver unit 204 such as the entrance roller 44, branching member 46, and conveying roller 70, the sheet take-in portion 50, the saddle unit 86, and the sheet folding unit 90.

Figure 4A:
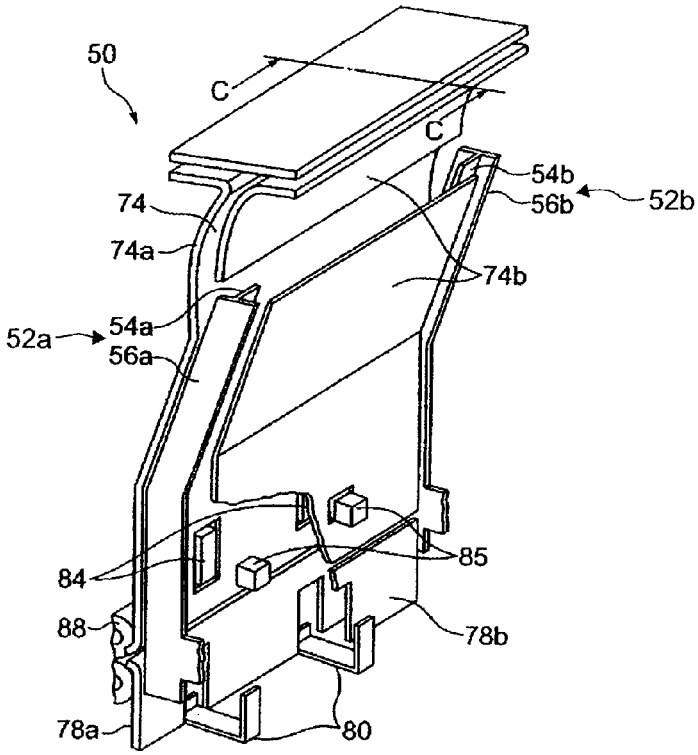
FIG. 4A is a schematic perspective view of the sheet take-in portion having a guide member of the first embodiment.
Figure 4B:
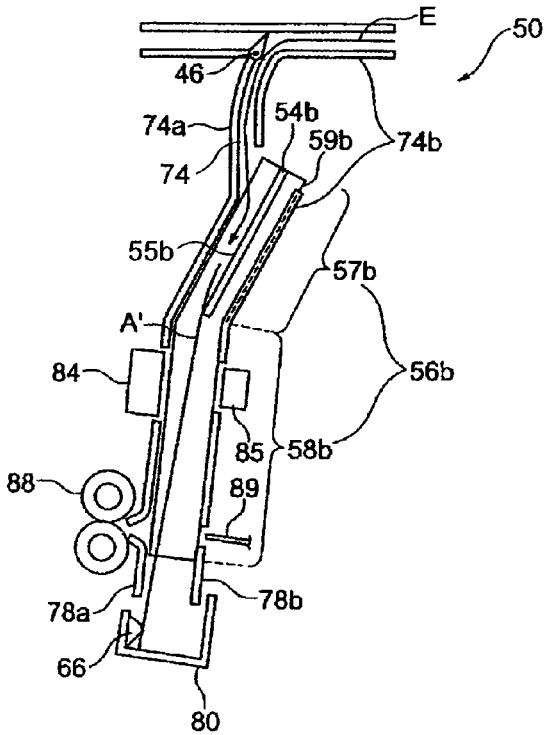
FIG. 4B is a schematic partial cross sectional view of the sheet take-in portion having a guide member of the first embodiment which is viewed in the direction of an arrow C shown in FIG. 4A.

FIG. 4A is a schematic perspective view (a partial section) of the sheet take-in portion 50 and FIG. 4B is a schematic cross sectional view viewed in the direction of the arrow C shown in FIG. 4A.

As shown in FIGS. 4A and 4B, the sheet take-in portion 50 includes the stacker 80 for receiving the leading edge of sheets conveyed downward in the conveying direction, the guide members 74*a* and 74*b* for supporting the bottom of the sheets received by the stacker 80 and holding the sheets in a standing position, and the first and second guide members 52*a* and 52*b* for stacking the succeeding sheets conveyed following the sheet bundle stacked in the guide members 74*a* and 74*b* and the stacker 80 in a standing position so as to prevent the succeeding sheets from getting into the sheet bundle stacked already.

The first and second guide members 52*a* and 52*b* have the first and second guide plates 54*a* and 54*b* which are inclined to the perpendicular plane and receive and guide sheets conveyed on the path 74 composed by the guide members 74*a* and 74*b* and first and second side plates 56*a* and 56*b* to which the first and second guide plates 54*a* and 54*b* are attached. The surfaces of the first and second guide plates 54*a* and 54*b* for receiving sheets conveyed on the path 74 are defined as a guide surface. The first and second guide plates 54*a* and 54*b* serve as a deflection unit for deflecting the sheet conveying direction to a fixed direction and even if the first and second guide plates 54*a* and 54*b* are fixed to the first and second side plates 56*a* and 56*b*, in order to adjust the deflection direction, the first and second guide plates 54*a* and 54*b* may be attached so that the inclined angle can be adjusted.

The first and second side plates 56*a* and 56*b* have a first inclined portion 57*b* inclined at the same inclination angle as that of the first and second guide plates 54*a* and 54*b* inclined to the perpendicular plane and a second inclined portion 58*b* inclined more steeply than the first inclined portion 57*b*. The guide members 74*a*, 74*b*, 78*a*, and 78*b* are arranged along the side plate 56*b*.

Figure 5:
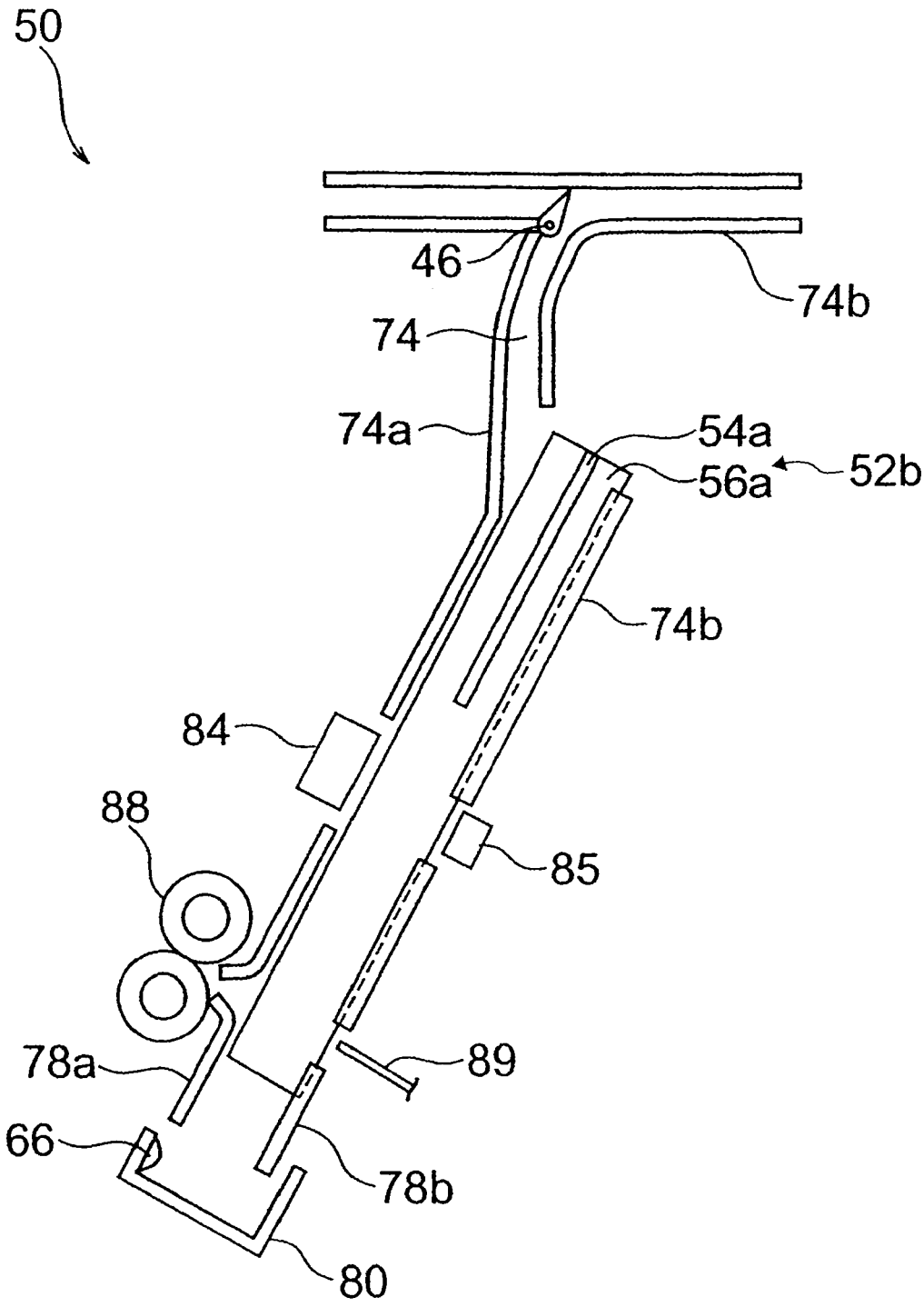
FIG. 5 is a schematic view showing a modification of the guide member of the first embodiment.

Further, the top of the guide member 74*b* on the portion of the side plate 56*b*, for example, arranged along the first inclined portion 57*b* is positioned on the side of the guide member 74*a* from a side surface 59*b* on the side of the guide member 74*b* of the side plate 56*b*. Therefore, the side plate 56*b* can perform the lateral alignment of a sheet bundle which will be described later. The side plate 56*b*, as shown in FIG. 5, may have a shape that the inclinations of the first and second inclined portions 57*b* and 58*b* are the same, that is, the side plate 56*b* of the second guide member 52*b* may have a linear shape.

The branching member 46 deflects a sheet A' in the direction of an arrow E shown in FIG. 4B. The sheet A' reaches the first and second guide members 52*a* and 52*b* via the path 74 composed by the guide members 74*a* and 74*b*. The first and second guide plates 54*a* and 54*b* guide the sheet A' received by the guide surfaces between the guide member 74*a* and the first and second guide plates 54*a* and 54*b* If the sheet A' drops further with the leading edge thereof in the conveying direction directed downward along the guide members 74*a* and 78*a*, the stacker 80 receives the leading edge of the sheet A' in the conveying direction. Even when the size of the sheet A' is the minimum size of the standard, the trailing edge of the sheet A' may be held by the first and second guide plates 54*a* and 54*b*. Further, to detect that the leading edge of the dropped sheet A' reaches the stacker 80, for example, a sheet sensor 66 such as a microsensor or a microactuator is installed.

Figure 6:
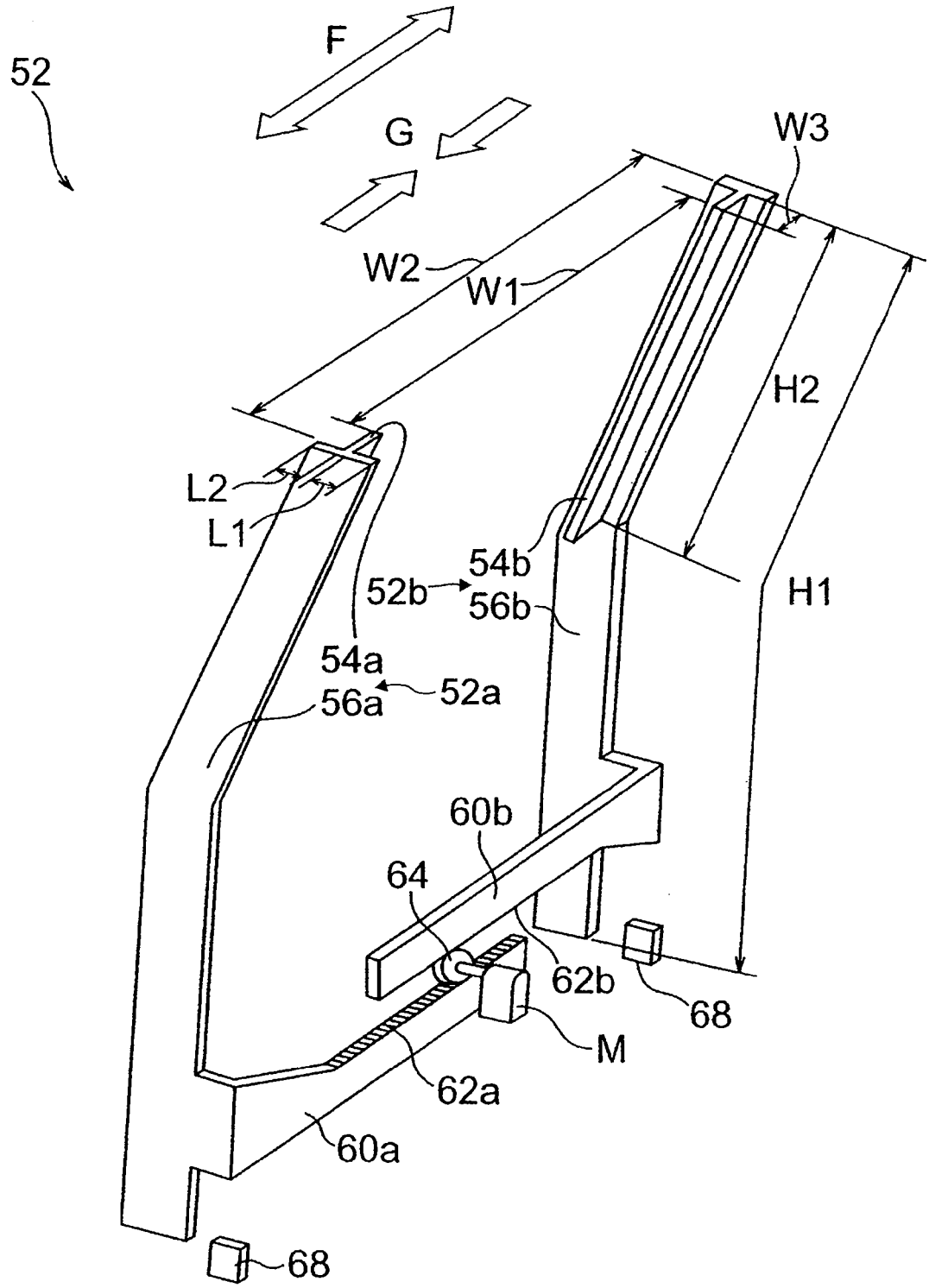
FIG. 6 is a schematic view for explaining the drive mechanism of the guide member of the first embodiment.

As shown in FIG. 6, the first and second guide members 52*a* and 52*b* are installed in the first and second side plates 56*a* and 56*b* and have first and second arms 60*a* and 60*b* which are mutually parallel toward the first and second guide members 52*b* and 52*a* respectively installed at the opposite position and are partially opposite to each other. Further, prior to explanation, the sheet width is assumed as a sheet length in the direction perpendicular to the sheet conveying direction.

The first and second arms 60*a* and 60*b* have respectively racks 62*a* and 62*b* on the opposite surfaces. Between the first and second arms 60*a* and 60*b*, a pinion gear 64 simultaneously fit into the racks 62*a* and 62*b* is arranged.

To the pinion gear 64, a motor M is connected. The pinion gear 64 rotates, thus the first and second side plates 56*a* and 56*b* move in the direction crossing the inclination direction of the guide surfaces, that is, in the mutually opposite directions to the sheet width direction crossing the sheet conveying direction. Further, the positions of the first and second side plates 56*a* and 56*b* in the sheet width direction, for example, are detected by a position detector 68 having a microsensor or a microactuator. Therefore, the first and second guide members 52*a* and 52*b* are controlled in the movement in the direction of an arrow F and the movement in direction of an arrow G by the drive mechanism having the first and second arms 60*a* and 60*b*, racks 62*a* and 62*b*, pinion gear 64, and motor M, the controller 203, and the position detector 68 and take the open state that a distance W1 between the leading edges of the first and second guide plates 54*a* and 54*b* is the sheet width or longer (the first interval) and the closed state that is smaller than the sheet width (the second interval).

Further, when the sheets are conveyed, the first and second guide plates 54*a* and 54*b* stand by taking the distance W1 between the leading edges in the closed state, though a distance W2 between the first and second side plates 56*a* and 56*b* is the width of the sheets conveyed or longer (may be equal to or wider than the sheet width).

Further, as mentioned above, the sheet stacking surface of the guide member 74*b* is positioned on the side of the guide member 74*a* more than the side surface 59*b* of the side plates 56*a* and 56*b* on the side of the guide member 74*b*. The side plates 56*a* and 56*b*, when moving in the direction of the arrow G and taking the closed state, perform the lateral alignment of the stacked sheets in the width direction.

The dimensions of the first and second guide members 52*a* and 52*b* may be decided in consideration of the specified sheet thickness and the number of stacking sheets. For example, in consideration of stacking of 20 sheets of ordinary paper, L1=20 mm and W3=30 mm may be acceptable. Further, L2 of the side plates 56, one sheet can be conveyed, may be sufficiently several millimeters. The longer the length H1 of the side plates 56 may be though to perform the lateral alignment of a sheet bundle, the length in contact with the sheet bundle may be about 200 mm. Further, the length H2 of the first and second guide plates 54*a* and 54*b*, in correspondence to a predetermined specified sheet size, is a length to prevent the succeeding sheets from getting into the sheet bundle stacked already.

FIG. 7 is a schematic view for explaining the sheet stacking operation by the guide member of the sheet take-in portion.

As shown in FIG. 7, the guide members 74*b* and 78*b* and the stacker 80 stack the sheet bundle A in a standing position. The stacker 80 stands by at the position corresponding to the stapling position B where the center of the sheet bundle A is stapled by the stapler 84 and anvil 85. Further, the positions of the first and second side plates 56*a* and 56*b* of the first and second guide members 52*a* and 52*b* in the sheet width direction are detected by the position detector 68.

Firstly, when sheets are conveyed along the path by the guide members 74*b* and 74*b*, the controller 203, on the basis of the positions of the first and second guide members 52*a* and 52*b* which are detected by the position detector 68, controls the drive mechanism and permits the first and second guide members 52*a* and 52*b* to stand by at the position where the distance W1 between the leading edges of the first and second guide plates 54*a* and 54*b* takes the closed state.

Figures 7A, 7B, 7C:
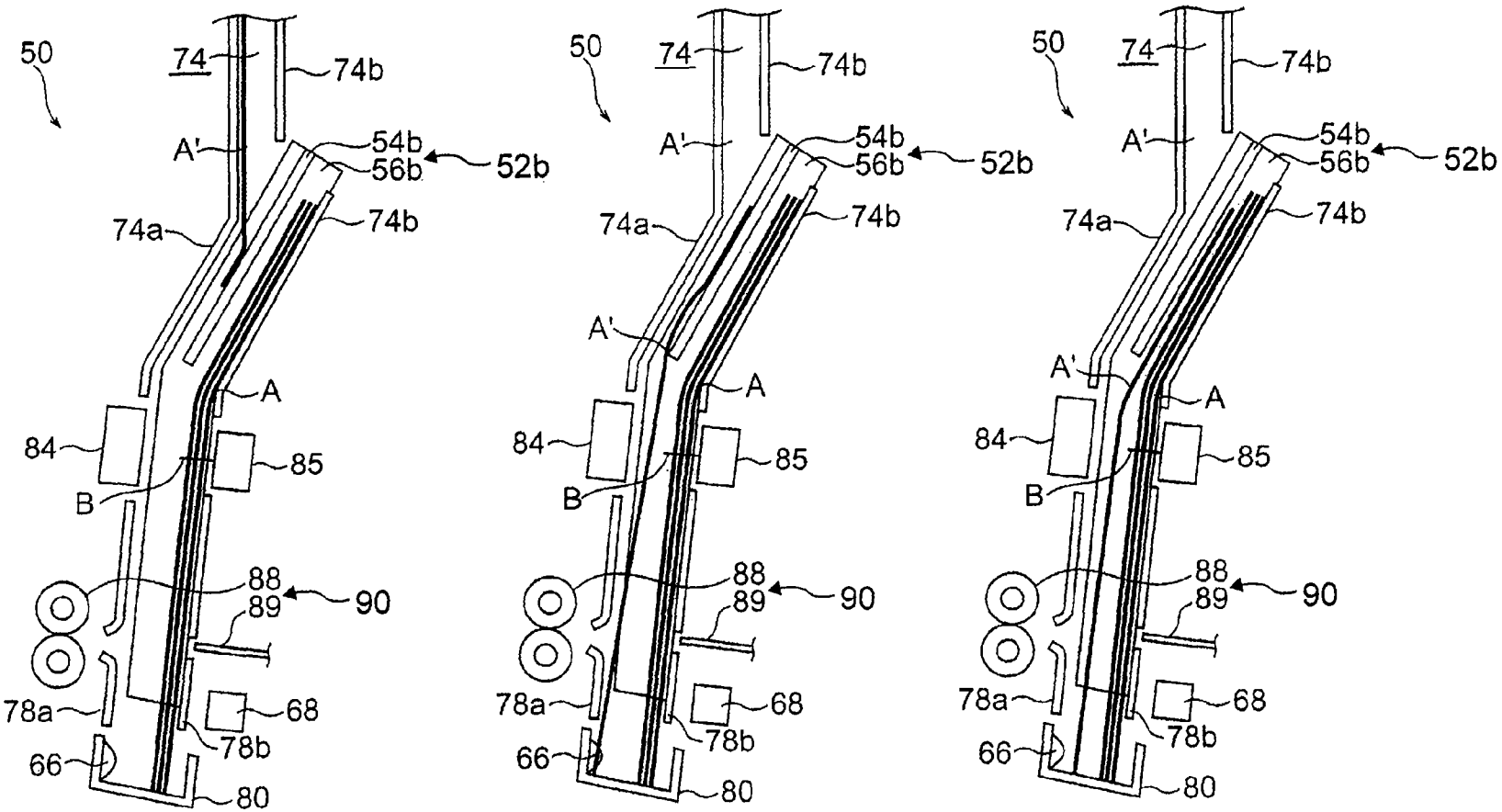
FIG. 7 is a schematic view for explaining the sheet stacking operation of the sheet take-in portion of the first embodiment.

Therefore, as shown in FIG. 7A, if the sheet A' is conveyed, the first and second guide plates 54*a* and 54*b* of the first and second guide members 52*a* and 52*b* standing by at the position where the closed state is taken receive the leading edge of the sheet A' in the conveying direction by the guide surfaces, deflect the conveying direction of the sheet A', and guide the sheet A' between the guide member 74*a* and the first and second guide plates 54*a* and 54*b*.

If the sheet A' drops with its leading edge in the conveying direction directed downward along the guide members 74*a* and 78*a*, as shown in FIG. 7B, the stacker 80 standing by under the first and second guide plates 54*a* and 54*b* receives the leading edge of the sheet A' in the conveying direction. The first and second guide plates 54*a* and 54*b* hold the trailing edge portion of the sheet A'.

If the sheet sensor 66 detects that the leading edge of the sheet A' reaches the stacker 80, the controller 203, on the basis of the positions of the first and second guide members 52*a* and 52*b* detected by the position detector 68, controls the drive mechanism and moves the first and second guide members 52*a* and 52*b* up to the position where the distance W1 between the leading edges of the first and second guide plates 54*a* and 54*b* takes the open state.

If the first and second guide members 52*a* and 52*b* take the open state and the distance W1 between the leading edges of the first and second guide plates 54*a* and 54*b* is extended sufficiently, as shown in FIG. 7C, the trailing edge portion of the sheet A' held by the first and second guide plates 54*a* and 54*b* drops (or falls down) on the side of the guide members 74*a* and 78*a* through the gap between the leading edges of the first and second guide plates 54*a* and 54*b* and is stacked on the uppermost portion of the stacked sheet bundle A.

If the sheet A' guided by the first and second guide plates 54*a* and 54*b* drops through the gap between the leading edges of the first and second guide plates 54*a* and 54*b* and is stacked on the sheet bundle A, the controller 203, on the basis of the positions of the first and second guide members 52*a* and 52*b* detected by the position detector 68, controls the drive mechanism, moves the first and second guide members 52*a* and 52*b* in the opposite direction to the direction when the open state is taken, and permits the first and second guide members 52*a* and 52*b* to stand by at the position where the distance W1 between the leading edges of the first and second guide plates 54*a* and 54*b* takes the closed state. Further, the first and second side plates 56*a* and 56*b* of the first and second guide members 52*a* and 52*b*, when taking the closed state aforementioned, perform the lateral alignment of the sheet bundle A in the width direction.

The first and second guide members 52*a* and 52*b* performing the lateral alignment stand by in the closed state and receive and guide the leading edges of another sheets conveyed subsequently.

The first and second guide members 52*a* and 52*b* repeat the aforementioned operation, thereby stack sequentially another sheets A' conveyed subsequently by preventing the another sheets A' from getting into the stacked sheet bundle A.

Further, if the sheet bundle A composed of the instructed number of sheets from the image forming apparatus 1 or PC 201 is stacked and aligned, the stapler 84 and anvil 85 staple the sheet bundle A and then the sheet folding unit 90 folds the sheet bundle A and discharges the sheet bundle A to the receiving tray 98.

Figure 8:
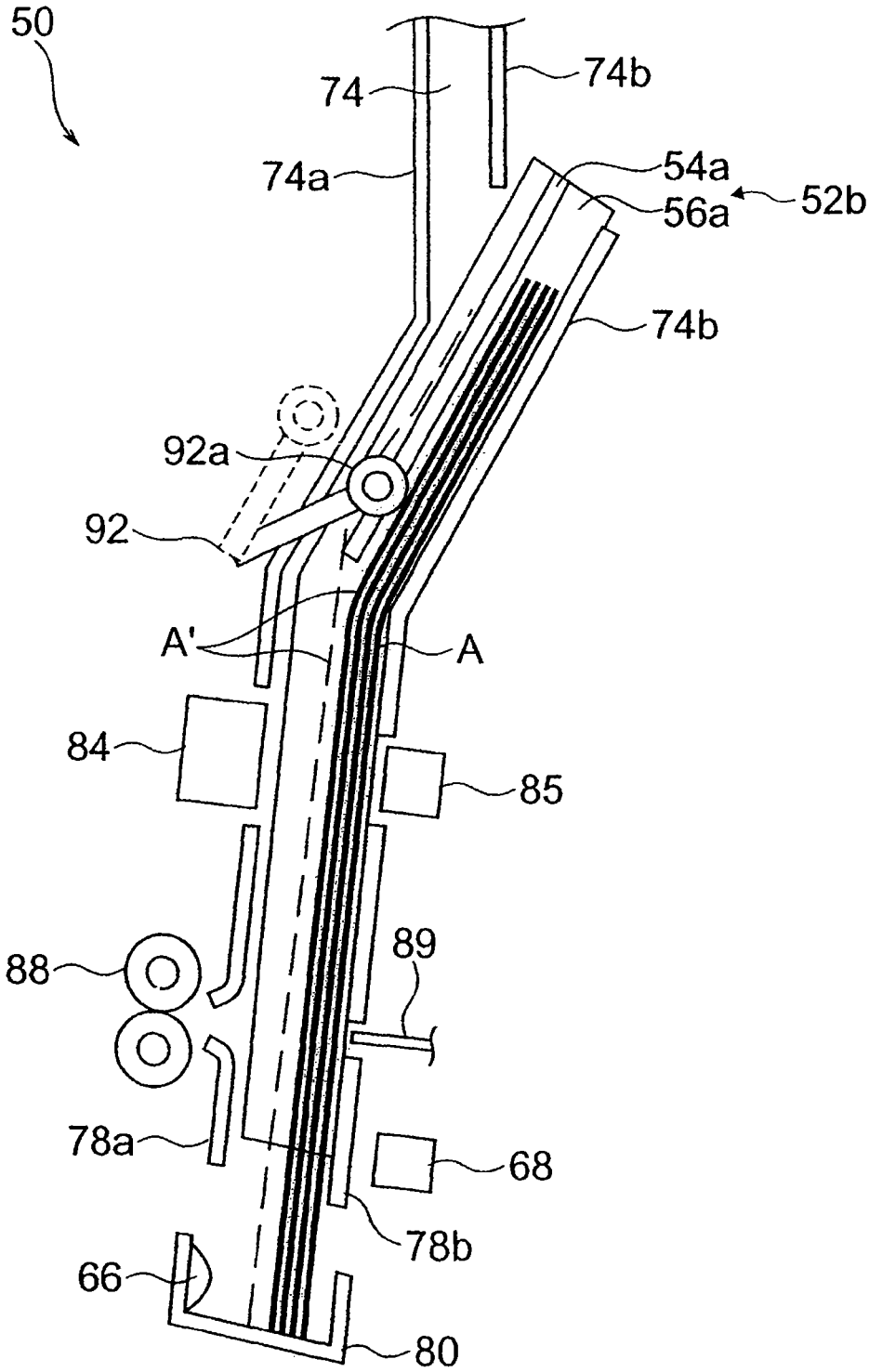
FIG. 8 is a schematic view showing a modification of the guide member of the first embodiment.

Further, as shown in FIG. 8, when the sheet A' reaches the stacker 80 and drops through the gap between the leading edges of the first and second guide plates 54*a* and 54*b* taking the open state, an assist member 92 for promoting the stacking operation for the sheet A' may be installed. The assist member 92, when the sheet A' is guided by the first and second guide members 52*a* and 52*b* taking the closed state, as shown by the dotted line, is shifted at the position where the assist member 92 is not an obstacle to conveyance and when dropping, rotates on the side of the guide member 74*b*, presses the Sheet A', thereby promotes stacking Further, the assist member 92 may rotate before the first and second guide plates 54*a* and 54*b* take perfectly the open state and promote the stacking operation for the sheet A'. Even if the interval between the leading edges of the first and second guide plates 54*a* and 54*b* taking the open state is narrower than the sheet width, the stacking operation can be performed and the time of the stacking operation can be shortened. Further, on the portion of the assist member 92 for pressing the sheet A', a rotatable roller 92*a* is installed, and the roller 92*a* is rotated, thus the longitudinal alignment of the sheet A' can be promoted.

Figure 9A:
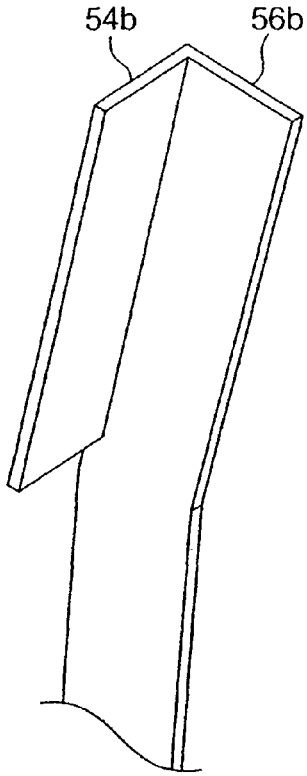
FIG. 9 is a schematic view showing a modification of the guide member of the first embodiment.
Figure 9B:
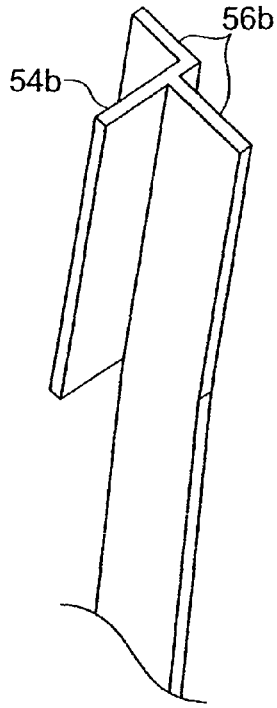

Further, as shown in FIG. 9A, the first and second guide members 52*a* and 52*b* may have a sectional shape of an L type depending on the guide plates 54*a* and the side plate 56*b* and as shown in FIG. 9B, the side plate 56*b* may be shaped so that the interval between the first and second side plates 56*a* and 56*b* on the side of receiving the sheet A' conveyed is wide and the interval on the side of aligning the sheet bundle A is narrow.

According to the sheet take-in portion 50, the first and second guide plates 54*a* and 54*b* having a guide surface inclined to the perpendicular plane for taking the open state which is the first interval that the distance W1 between the leading edges is equal to or longer than the sheet width and the closed state which is the second interval that the distance W1 is shorter than the sheet width and the second interval is narrower than the first interval are used in the sheet width direction crossing the inclination direction, and the sheet A' conveyed is guided by the first and second guide plates 54*a* and 54*b* taking the closed state, and the sheet A' is dropped and stacked from the gap between the leading edges by the first and second guide plates 54*a* and 54*b* taking the open state, thus the succeeding sheets A' can be stacked sequentially without getting into the stacked sheet bundle A.

Further, the sheets A' are stacked using the same path without changing the path for conveying sheets, so that compared with the conventional apparatus, the number of paths for each sheet size can be reduced, thus the apparatus can be miniaturized.

Further, sheets are stacked using the same path, so that the numbers of flappers and abnormal system sensors for detecting an abnormal system such as sheet jamming which must be installed in each path can be reduced and the number of components of the mechanism used to stack appropriately sheets and the man-hour for mounting the components can be reduced.

Further, the conventional apparatus, after the sheets are all conveyed, performs the lateral alignment of the sheet bundle, so that several alignment operations are required whenever the closed state is taken to stack the sheet A', the side plates 56 perform the lateral alignment, so that during conveyance of a series of sheets A', the lateral alignment of the sheet bundle A is performed. Therefore, the number of times of alignment operations of the sheet bundle A after all the sheets A' are stacked can be reduced and the processing time can be shortened. Further, in addition to the first and second guide members 52*a* and 52*b*, there is no need to separately install a lateral alignment unit, so that the cost can be reduced and the apparatus can be miniaturized.

Further, the side plates 56 are composed of the first and second inclined portions 57 and 58, so that the first inclined portion 57 gently inclined, when the first and second guide members 52*a* and 52*b* take the open state, holds the trailing edges of the sheets so as to permit the sheets to easily fall down on the side of the guide member 74*b*, and the path is arranged along the second inclined portion inclined more steeply than the first inclined portion 57, so that the horizontal direction for stacking the sheets can realize space saving.

The first and second guide plates 54*a* and 54*b* of the first and second guide members 52*a* and 52*b*, when taking the closed state, perform the lateral alignment of the sheet bundle A, then open the interval between the leading edges, stand by in the state, and may receive another subsequent sheets A'. The movement distances of the first and second guide members 52*a* and 52*b* for taking the open and closed states are the same, so that there is no change in the processing time, and an allowance is given in the width direction when receiving the sheets A' conveyed, so that smooth conveyance is available.

The leading edges of the first and second guide plates 54*a* and 54*b* at the closed state take an interval to receive another sheets conveyed subsequently. Then, the lateral alignment of the sheet bundle A may be performed after the sheets are all stacked.

After the leading edge of the sheets A' conveyed by the first and second guide members 52*a* and 52*b* taking the closed state reaches the stacker 80, the first and second guide members 52*a* and 52*b* may start movement to take the open state. At the point of time before arrival of the leading edge of the sheets A' conveyed by the first and second guide members 52*a* and 52*b* at the stacker 80 so that the leading edge of the sheets A' dropping from the guide plates 54 does not enter the stacked sheet bundle A, the first and second guide members 52*a* and 52*b* may start movement to take the open state. The sheet sensor 66 may be set at the position where the leading edge of each sheet passing the portion below the upper end of the sheet bundle A stacked in a standing position can be detected. For example, the sheet sensor 66 may be set at the position where the leading edge of each sheet passing the position of the lower end portion of the guide plates 54 halfway the path and the position where the saddle unit 88 is arranged. Namely, as mentioned above, before the leading edge of the sheets A' reaches the stacker 80, the sheets A' are dropped from the guide plates 54, thus the processing time required for the stacking operation can be shortened.

Second Embodiment

Figure 10A:
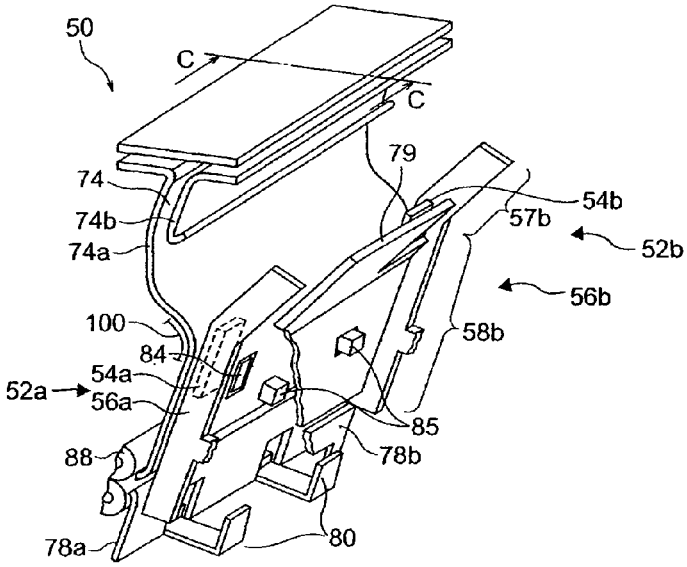
FIG. 10A is a schematic perspective view of the sheet take-in portion having a guide member of the second embodiment.
Figure 10B:
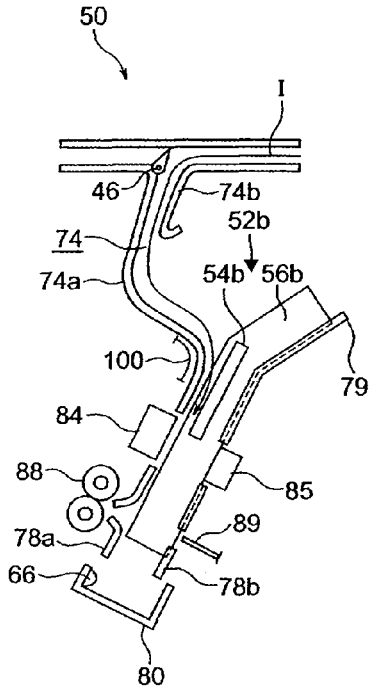
FIG. 10B is a schematic partial cross sectional view viewed in the direction of the arrow C shown in FIG. 10A.

FIG. 10A is a schematic perspective view (partial section) of the sheet take-in portion 50 having the first and second guide members 52*a* and 52*b* and FIG. 10B is a schematic cross sectional view viewed in the direction of the arrow C shown in FIG. 10A.

The guide plates 54*a* and 54*b* are installed on the second inclined portions 58*a* and 58*b* inclined more steeply than the first inclined portion 57 of the side plates 56*a* and 56*b*. The guide plates 54*a* and 54*b* deflect the conveying direction of the conveyed sheets to a fixed direction and guide the conveyed sheets.

Further, numeral 79 indicates a tongue on which the sheet bundle the leading edge of which is received by the stacker 80 is stacked.

Further, among the guide members 74*a* and 74*b* composing the path 74, the guide member 74*a* has a curved portion 100 having a structure of conveying sheets downward from above, curving at the position where the sheets are guided by the guide surfaces of the guide plates 54*a* and 54*b* on the opposite side of the side where the guide plates 54*a* and 54*b* are arranged, and curving the sheets together with the guide surfaces of the guide plates 54*a* and 54*b*.

The branching member 46 deflects the sheets A' in the direction of an arrow I shown in FIG. 10B. The sheets A' pass on the path 74 composed by the guide members 74*a* and 74*b*, pass through the curved portion 100, and reach the first and second guide members 52*a* and 52*b*. The guide plates 54*a* and 54*b* of the first and second guide members 52*a* and 52*b* guide the sheets A' that the leading edges thereof in the conveying direction are received by the guide surfaces between the guide member 74*a* and the first and second guide members 52*a*, 52*b*. The sheets A' move by curving between the first and second guide members 52*a*, 52*b* and the guide member 74*a* along the curved portion 100 of the guide member 74*a*. If the sheets A' drop along the guide members 74*a* and 78*a* with the leading edge thereof in the conveying direction directed downward, the stacker 80 receives the leading edge of the sheet A' in the conveying direction.

Further, the trailing edge portion of each of the sheets A' conveyed by being curved along the curved portion 100 between the guide plates 54*a* and 54*b* and the guide member 74*a*, due to the hardness of the sheet itself or the rigidity due to the bending strength, is intended to return to its original state from the curved state and is displaced toward the tongue 79 from the side of the guide member 74*a*. Particularly the sheets A' are under conveyance, so that as the trailing edge of each of the sheets A' approaches the first and second guide members 52*a* and 52*b*, falls down easily toward the tongue 79.

The positions of the upper portions of the guide plates 54*a* and 54*b* may be able to deflect sheets conveyed and may be equal to or above the uppermost portion among the intersection points of the tangent of the curved portion 100 with the guide plates 54 so as not to prevent the falling operation toward the tongue 79 when intending to return to the original state from the curved state of the sheets.

The sheet stacking operation by the first and second guide members 52*a* and 52*b* will be explained. FIG. 11 is a schematic view for explaining the sheet stacking operation by the guide member of the sheet take-in portion.

The guide member 78*b*, stacker 80, and tongue 79 stack the sheet bundle A in a standing position. The stacker 80 stands by at the position corresponding to the stapling position B where the center of the sheet bundle A is stapled by the stapler 84 and anvil 85. Further, the positions of the first and second side plates 56*a* and 56*b* of the first and second guide members 52*a* and 52*b* in the sheet width direction are detected by the position detector 68.

Firstly, when sheets are conveyed along the path 74, the controller 203, on the basis of the positions of the first and second guide members 52*a* and 52*b* which are detected by the position detector 68, controls the drive mechanism and permits the first and second guide members 52*a* and 52*b* to stand by at the position where the distance W1 between the leading edges of the first and second guide plates 54*a* and 54*b* takes the closed state.

Figure 11C:
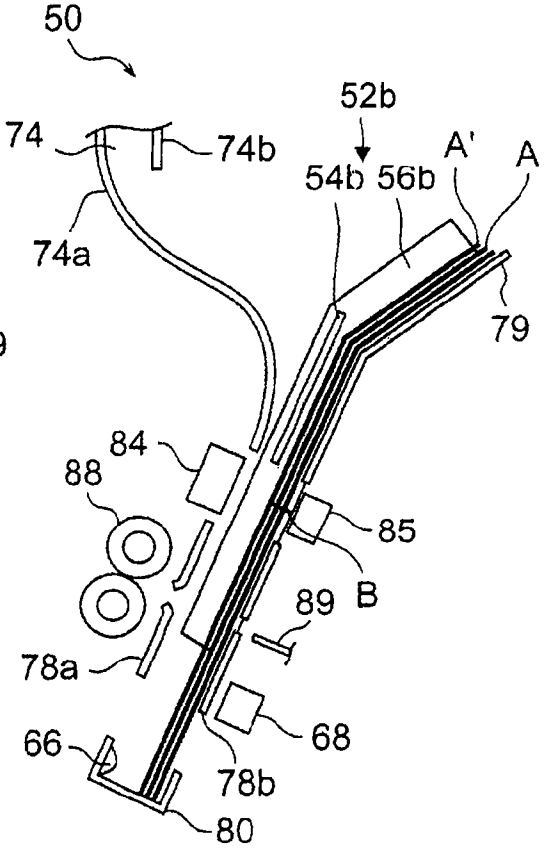
FIG. 11 is a schematic view for explaining the sheet stacking operation of the sheet take-in portion of the second embodiment.
Figure 11B:
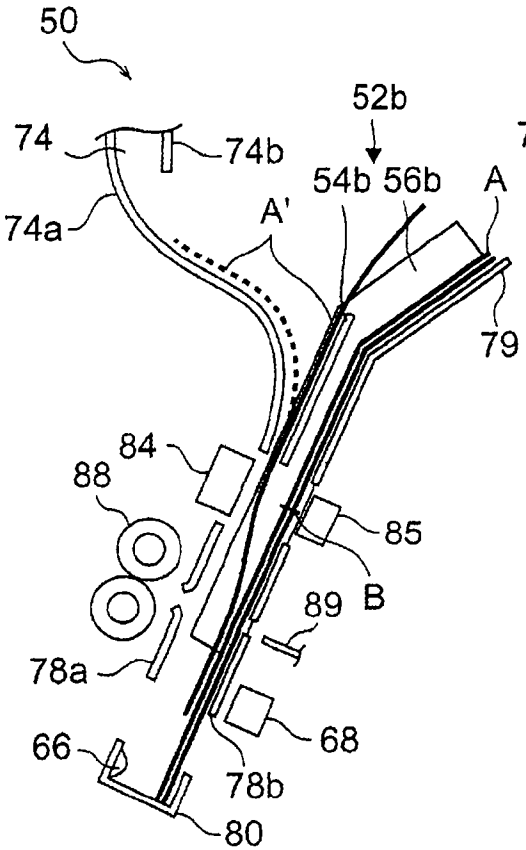
Figure 11A:
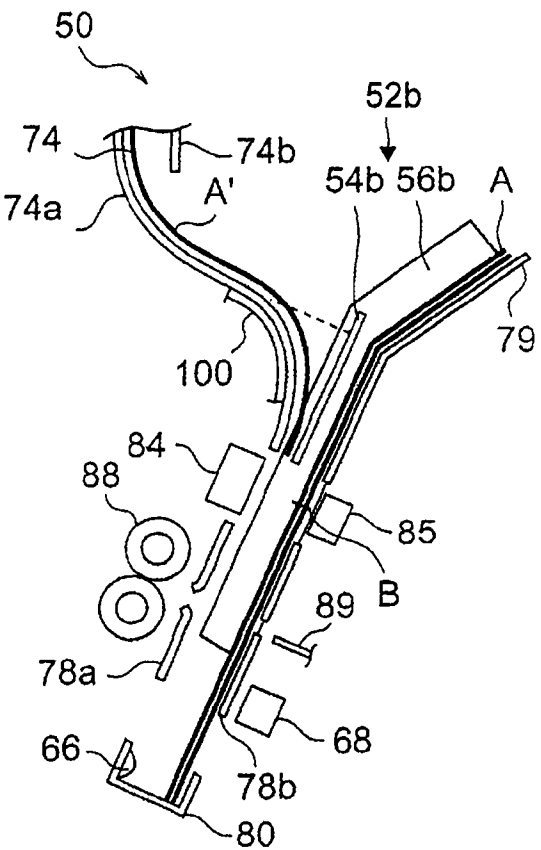
Figure 12A:
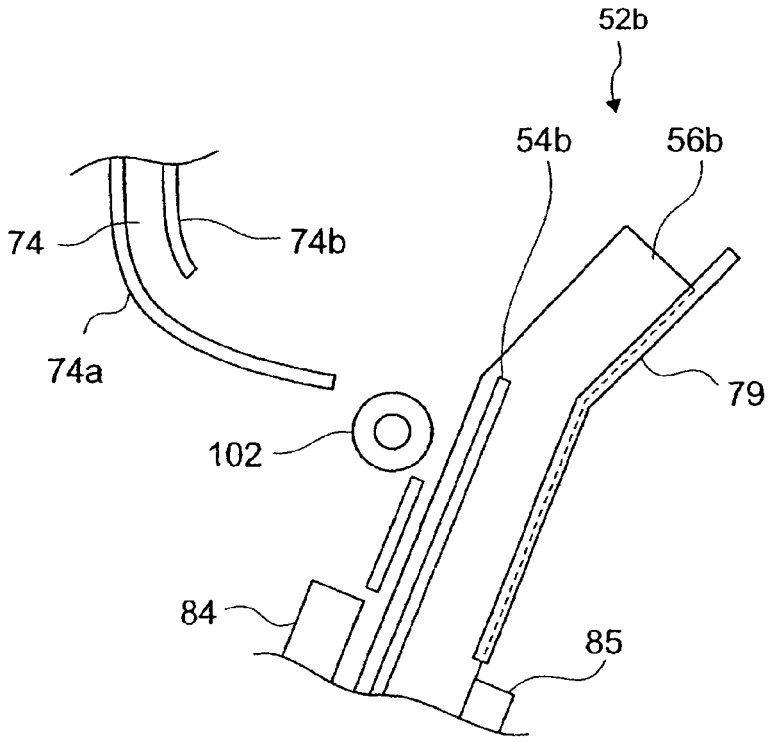
FIG. 12 is a schematic view showing a modification of the guide member of the second embodiment.
Figure 12B:
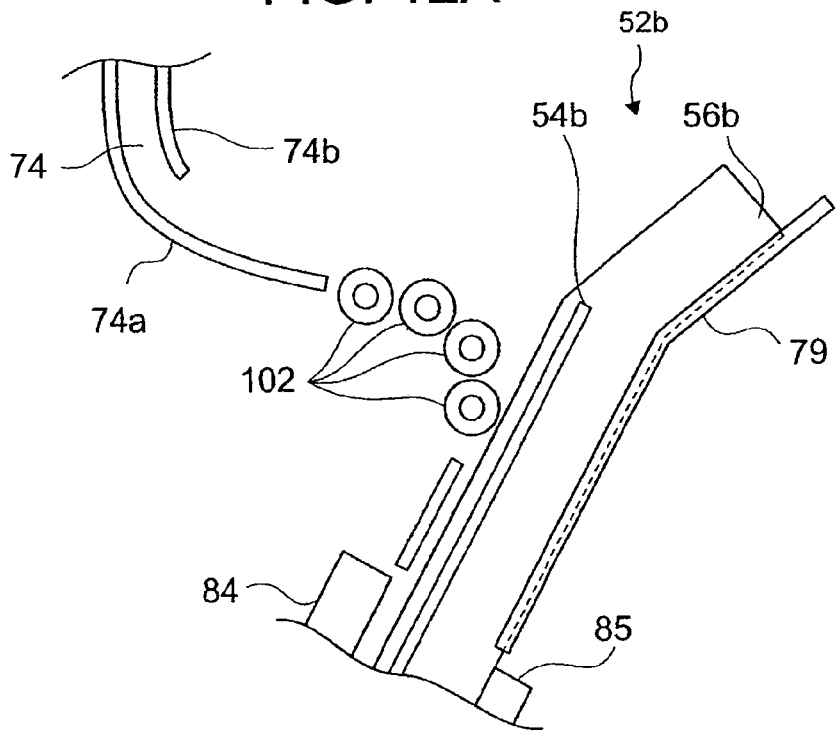

As shown in FIG. 11A, if the sheets A' pass the path 74, furthermore pass through the curved portion 100, and reach the first and second guide members 52*a* and 52*b*, the first and second guide plates 54*a* and 54*b* standing by at the position where the closed state is taken deflect the conveying direction of the sheet A' the leading edges of which are received by the guide surfaces and guide the sheet A' between the guide member 74*a* and the first and second guide plates 54*a* and 54*b*.

The sheets A' guided between the first and second guide plates 54*a*, 54*b* and the guide member 74*a*, as shown in FIG. 11B, move by curving along the curved portion 100 of the guide member 74*a* and further drop with the leading edge in the conveying direction directed downward along the guide members 74*a* and 78*a*. The sheets A' moving by curving, due to the hardness of the sheets or the rigidity of the sheets due to the bending strength, are intended to return to the original state of the sheets from the curved state, so that the trailing edge portion of the sheets A' moves from the position indicated by the dotted line toward the tongue 79. Further, when the sheets A' fall down on the side of the tongue 79, the controller 203 controls the drive mechanism and moves the first and second guide members 52*a* and 52*b* to the position where the distance W1 between the leading edges of the first and second guide plates 54*a* and 54*b* takes the open state.

If the first and second guide members 52*a* and 52*b* take the open state and the distance W1 between the leading edges of the first and second guide plates 54*a* and 54*b* is extended sufficiently, as shown in FIG. 11C, the trailing edge portion of the sheets A', due to the power of the sheets A' of intending to return to the original state from the curved state and its own weight, falls down from the gap between the trailing edges of the first and second guide plates 54*a* and 54*b* toward the tongue 79 and is stacked on the uppermost portion of the stacked sheet bundle A.

If the sheets A' fall down from the gap between the trailing edges of the first and second guide plates 54*a* and 54*b*, the controller 203, on the basis of the positions of the first and second guide members 52*a* and 52*b* detected by the position detector 68, controls the drive mechanism, moves the first and second guide members 52*a* and 52*b* in the opposite direction to the direction when the open state is taken, and permits the first and second guide members 52*a* and 52*b* to stand by at the position where the distance W1 between the leading edges of the first and second guide plates 54*a* and 54*b* takes the closed state. Further, the first and second side plates 56*a* and 56*b* of the first and second guide members 52*a* and 52*b*, when taking the closed state aforementioned, perform the lateral alignment of the sheet bundle A in the width direction.

The first and second guide members 52*a* and 52*b* performing the lateral alignment stand by in the closed state and receive and guide the leading edges of another sheets conveyed subsequently.

The first and second guide members 52*a* and 52*b* repeat the aforementioned operation, thereby stack sequentially another sheets A' conveyed subsequently by preventing the another sheets A' from getting into the stacked sheet bundle A.

The sheet take-in portion 50 curves the sheets by the curved portion 100 and promotes stacking using the restoration force of the sheets displaced to stack the sheets smoothly.

The curvature structure of the curved portion 100 may be formed by a conveying member 102 such as a conveying roller or a roller.

Before the leading edge of sheets conveyed by the first and second guide members 52*a* and 52*b* reaches the stacker 80, the first and second guide members 52*a* and 52*b* start to move in order to take the open state. After the leading edge of the sheets reaches the stacker 80, the first and second guide members 52*a* and 52*b* may start to move in order to take the open state.

Third Embodiment

Figure 13B:
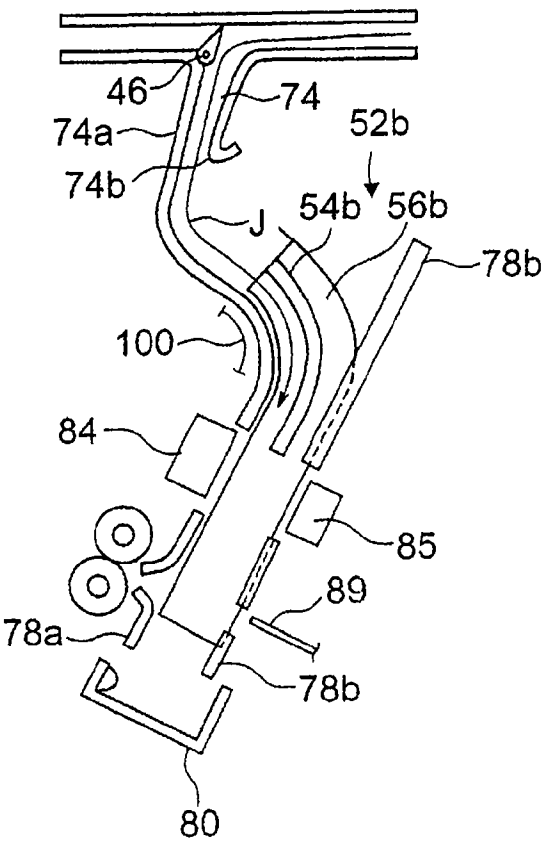
FIG. 13B is a schematic partial cross sectional view viewed in the direction of the arrow C shown in FIG. 13A.
Figure 13A:
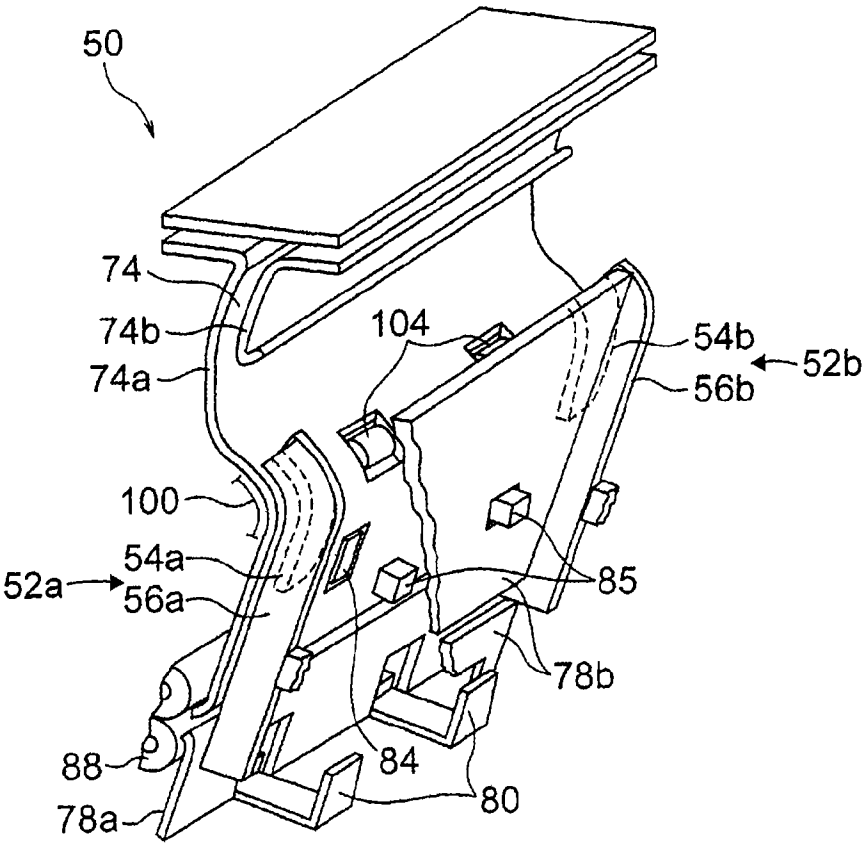
FIG. 13A is a schematic perspective view of the sheet take-in portion having a guide member of the third embodiment.

FIG. 13A is a schematic perspective view (partial section) of the sheet take-in portion 50 having the first and second guide members 52*a* and 52*b* of the third embodiment and FIG. 13B is a schematic cross sectional view viewed in the direction of the arrow C shown in FIG. 13A.

The guide member 74*a* has the curved portion 100 for curving the sheets conveyed at the position where the sheets are guided by the guide surfaces of the guide plates 54 together with the guide surfaces of the guide plates 54. Further, the guide member 74*a* has a conveying member 104 for promoting sheet conveyance in the curved portion 100.

Further, the first and second side plates 56*a* and 56*b* of the first and second guide members 52*a* and 52*b* are arranged along the guide members 74*a* and 78*a* extending over from the curved portion 100 of the guide member 74*a* to the guide member 78*a* and the first and second guide plates 54*a* and 56*b*, in the curved portion 100, are installed in the side plates 56*a* and 56*b* by curving so as to bend the sheets.

The branching member 46 deflects the sheets A' in the direction of an arrow J shown in FIG. 13B. The sheets A' move between the curved portion 100 and the guide plates 54 by curving via the path 74 composed by the guide members 74*a* and 74*b*. If the sheets A' drop with the leading edge thereof in the conveying direction directed downward along the guide members 74*a* and 78*a*, the stacker 80 receives the leading edge of the sheets A' in the conveying direction. The lower end portions of the guide plates 54 are positioned below the trailing edge of a minimum-size sheet the leading edge of which is supported by the stacker 80 in the conveying direction. Therefore, the succeeding sheets conveyed will not get into the stacked sheet bundle. The guide member 78*b* serves as the tongue 79.

FIG. 14 is a schematic view for explaining the sheet stacking operation by the guide member of the sheet take-in portion.

The sheet bundle A the leading edge of which is received by the stacker 80 is stacked in a standing position with the bottom thereof supported by the guide member 78*b*. The stacker 80 stands by at the position corresponding to the stapling position B where the center of the sheet bundle A is stapled by the stapler 84 and anvil 85. Further, the position detector 68 detects the positions of the first and second side plates 56*a* and 56*b* of the first and second guide members 52*a* and 52*b* in the sheet width direction.

Firstly, when sheets are conveyed along the path 74, the controller 203, on the basis of the positions of the first and second guide members 52*a* and 52*b* which are detected by the position detector 68, controls the drive mechanism and permits the first and second guide members 52*a* and 52*b* to stand by at the position where the distance W1 between the leading edges of the first and second guide plates 54*a* and 54*b* takes the closed state according to the sheet size.

Figures 14A, 14B, 14C:
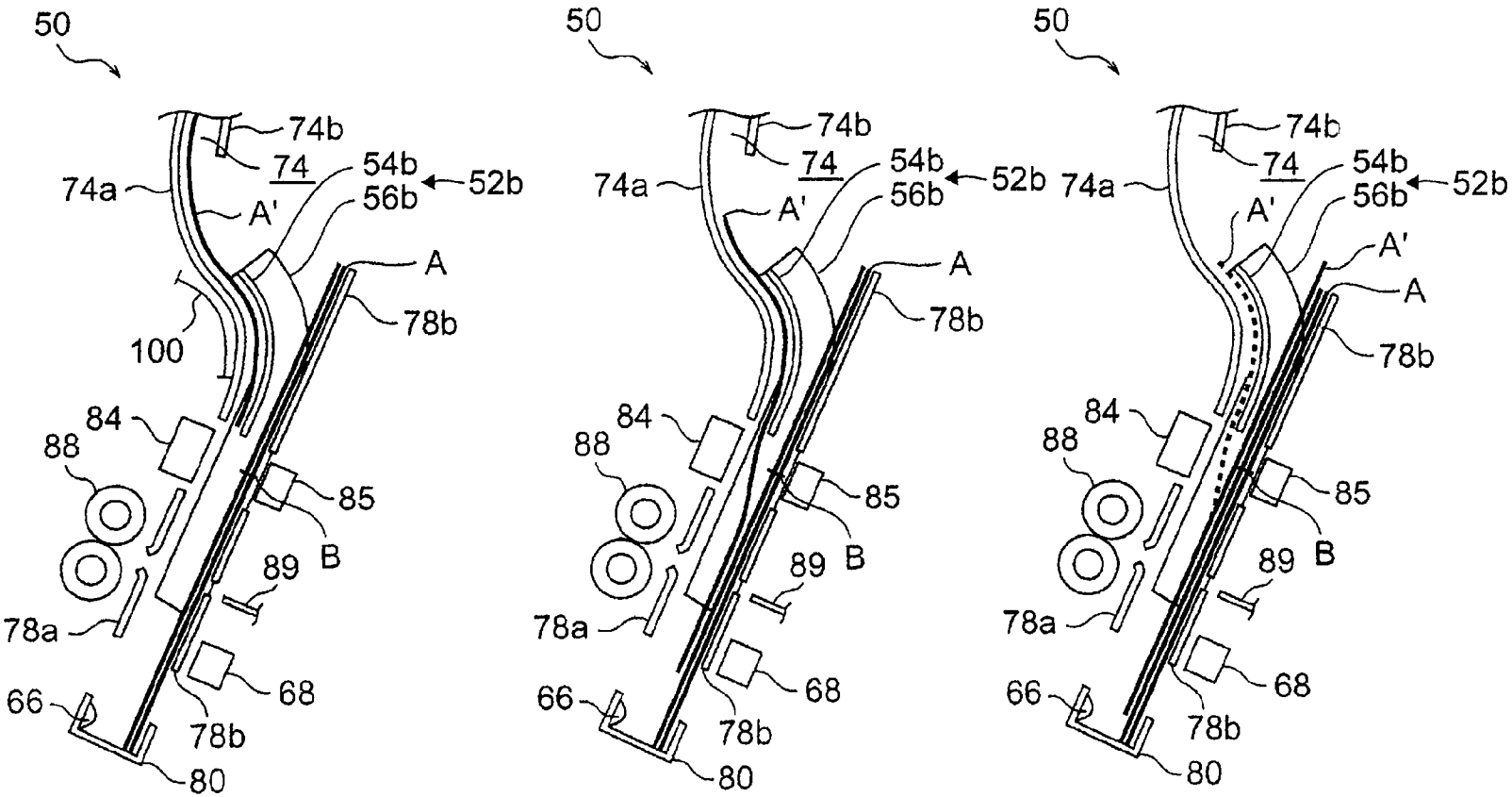
FIG. 14 is a schematic view for explaining the sheet stacking operation of the sheet take-in portion of the third embodiment.

As shown in FIG. 14A, if the sheets A' pass the path 74 and reach the first and second guide members 52*a* and 52*b*, the first and second guide plates 54*a* and 54*b* standing by with the closed state taken deflect the conveying direction of the sheets A' along the guide surfaces. The sheets A' deflected along the guide surfaces move by curving between the guide plates 54*a* and 54*b* and the curved portion 100 of the guide member 74*a*.

As shown in FIG. 14B, the sheets A' moving by curving between the guide plates 54 and the curved portion 100 and dropping with the leading edge in the conveying direction directed downward along the guide members 74*a* and 78*a*, due to the hardness of the sheets or the rigidity of the sheets due to the bending strength, are intended to return to the original state of the sheets from the curved state. Particularly the sheets A' are under conveyance, so that as the trailing edge of each of the sheets A' approaches the curved portion 100, the curved portion of the sheets A' falls down easily toward the guide member 78*b*. The guide plates 54*a* and 54*b* control the motion of the sheets A' of falling down toward the guide member 78*b*.

Then, the controller 203 controls the drive mechanism and moves the first and second guide members 52*a* and 52*b* up to the position where the distance W1 between the leading edges of the first and second guide plates 54*a* and 54*b* takes the open state.

If the first and second guide members 52*a* and 52*b* take the open state and the distance W1 between the leading edges of the first and second guide plates 54*a* and 54*b* is extended sufficiently, the control for the sheets A' by the guide plates 54 is released, so that as shown in FIG. 14C, the trailing edge portion of the sheets A', due to the power of the sheets A' of intending to return to the original state from the curved state and its own weight, falls down from the position indicated by the dotted line toward the guide member 78*b* and is stacked on the uppermost portion of the stacked sheet bundle A.

If the sheets A' fall down from the gap between the trailing edges of the first and second guide plates 54*a* and 54*b*, the controller 203, on the basis of the positions of the first and second guide members 52*a* and 52*b* detected by the position detector 68, controls the drive mechanism, moves the first and second guide members 52*a* and 52*b* in the opposite direction to the direction when the open state is taken, and permits the first and second guide members 52*a* and 52*b* to stand by at the position where the distance W1 between the leading edges of the first and second guide plates 54*a* and 54*b* takes the closed state. Further, the first and second side plates 56*a* and 56*b* of the first and second guide members 52*a* and 52*b*, when taking the closed state aforementioned, perform the lateral alignment of the sheet bundle A in the width direction.

The first and second guide members 52*a* and 52*b* repeat the aforementioned operation, thus another sheets A' conveyed subsequently are sequentially stacked without getting into the stacked sheet bundle A.

The sheet take-in portion 50 controls the displacement due to the rigidity of sheets by the guide plates 54. For example, according to the size and physical properties of sheets, at the position where the sheets are most powerful in returning to the original state, the first and second guide members 52*a* and 52*b* can be permitted to take the open state.

Before the leading edge of sheets conveyed to the first and second guide members 52*a* and 52*b* reaches the stacker 80, the first and second guide members 52*a* and 52*b* perform the open operation. After the leading edge of the sheets reaches the stacker 80, the first and second guide members 52*a* and 52*b* may start to move in order to take the open state.

The guide plates 54*a* and 54*b* are installed on the side plates 56*a* and 56*b*. The side plates 56*a* and 56*b* may not be used. The operations of taking the open and closed states by the side plates 56*a* and 56*b* and guide plates 54*a* and 54*b* may not be synchronized with each other. An article of performing the lateral alignment of a sheet bundle, instead of the side plates 56*a* and 56*b*, for example, may be a projection or a cylindrical member moving in the width direction of the sheet bundle or a member such as a hook.

Although the invention is shown and described with respect to certain illustrated aspects, it will be appreciated that equivalent alternations and modifications will occur to other skilled in the art upon the reading and understanding of this specification and the annexed drawings. In particular regard to the various functions performed by the above described components, the terms used to describe such components are intended to correspond, unless otherwise indicated, to any component which performs the specified function of the described component (e.g., that is functionally equivalent), even though not structurally equivalent to the disclosed structure, which performs the function in the herein illustrated exemplary aspects of the invention.

What is claimed is:

1. A sheet stacking apparatus, comprising:

first and second guide plates each having an inclined guide surface and forming a gap therebetween, the gap at an open state of the guide plates having a first spacing, the gap at a closed state of the guide plates having a second spacing narrower than the first spacing;

a sheet take-in portion disposed under the first and second guide plates to support sheets dropped from the guide surfaces, a leading edge of the sheets in a conveying direction being directed downward when the sheets are supported by the sheet take-in portion;

a sheet conveying path configured to convey the sheets downward from above, curving at a position where the sheets are guided by the guide surfaces, and configured to curve the sheets together with the guide surfaces; and a controller configured to permit the first and second guide plates to enter the closed state and guide additional sheets by the guide surface thereof, the additional sheets being conveyed following the sheets supported by the sheet take-in portion, and then to enter the open state and drop the additional sheets through the gap onto the sheets supported by the sheet take-in portion.

2. The apparatus according to claim 1, further comprising:

first and second side plates configured to move mutually in opposite directions and permit the first and second guide plates to take the open state and the closed state.

3. The apparatus according to claim 2, wherein the controller permits the first and second side plates to align both edges of the sheets stored in the sheet take-in portion when the first and second guide plates take the closed state.

4. The apparatus according to claim 2, wherein the first and second guide plates form a first inclined surface downward from above and a second inclined surface which is inclined more steeply than the first inclined surface.

5. The apparatus according to claim 1, wherein in the sheet conveying path, a guide roller is arranged at the curved position.

6. The apparatus according to claim 1, wherein the controller permits the first and second guide plates to take the open state when a trailing edge of the sheets guided and curved on the sheet conveying path falls down toward the guide surfaces of the first and second guide plates.

7. The apparatus according to claim 1 further comprising:

an assist member configured to strike the sheets from above to promote falling when the sheets drop through from the gap of the first and second guide plates.

8. The apparatus according to claim 7, wherein the assist member includes a roller that is configured to strike the sheets.

9. A sheet processing apparatus, comprising:

first and second guide plates each having an inclined guide surface and forming a gap therebetween, the gap at an open state of the guide plates having a first spacing, the gap at a closed state of the guide plates having a second spacing narrower than the first spacing;

a sheet take-in portion disposed under the first and second guide plates to support sheets dropped from the guide surfaces, a leading edge of the sheets in a conveying direction being directed downward when the sheets are supported by the sheet take-in portion;

a sheet conveying path configured to convey the sheets downward from above, curving at a position where the sheets are guided by the guide surfaces, and configured to curve the sheets together with the guide surfaces;

a controller configured to permit the first and second guide plates to enter the closed state and guide additional sheets by the guide surface thereof, the additional sheets being conveyed following the sheets supported by the sheet take-in portion, and then to enter the open state and drop the additional sheets through the gap onto the sheets supported by the sheet take-in portion;

a saddle unit configured to staple a plurality of sheets stacked in the sheet take-in portion; and a sheet folding unit configured to fold the plurality of sheets stapled by the saddle unit.

10. A sheet stacking method, comprising:

conveying sheets downward from above first and second guide plates each having an inclined guide surface, through a sheet conveying path that is curved at a position where the sheets are guided by the guide surfaces, the sheets being curved while being conveyed by the sheet conveying path together with the guide surfaces supporting the sheets conveyed through a gap formed between the first and second guide plates in a standing position; and moving the first and second guide plates so that the gap has a first spacing and the guide surfaces of the guide plates guide additional sheets that are conveyed following the sheets supported in the standing position, and moving the first and second guide plates so that the gap has a second spacing that is wider than the first spacing and the additional sheets are dropped through the gap onto the sheets supported in the standing position.

11. The method according to claim 10 further comprising:

installing the first and second guide plates in first and second side plates, permitting the first and second side plates to move mutually in opposite directions, and permitting the first and second guide plates to take the open state and the closed state.

12. The method according to claim 11, wherein both edges of the sheets stored in the sheet take-in portion are trued up by the first and second side plates when the first and second guide plates take the closed state.

13. The method according to claim 11, wherein the first and second guide plates form a first inclined surface downward from above and a second inclined surface which is inclined more steeply than the first inclined surface.

14. The method according to claim 10, wherein a guide roller is arranged at the curved position.

15. The method according to claim 10, wherein the first and second guide plates take the open state when a trailing edge of the curved sheets in the conveying direction falls down toward the guide surfaces.

16. The method according to claim 10 further comprising:

striking the sheets from above by an assist member to promote and falling when the sheets drop through the gap of the first and second guide plates.

17. The method according to claim 16, wherein the assist member strikes the sheets with a roller.

* * * * *